US008089329B2

(12) United States Patent
Tsukahara

(10) Patent No.: US 8,089,329 B2
(45) Date of Patent: Jan. 3, 2012

(54) SEMICONDUCTOR SWITCH, SEMICONDUCTOR SWITCH MMIC, CHANGEOVER SWITCH RF MODULE, POWER RESISTANCE SWITCH RF MODULE, AND TRANSMITTER AND RECEIVER MODULE

(75) Inventor: Yoshihiro Tsukahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 272 days.

(21) Appl. No.: 12/613,557

(22) Filed: Nov. 6, 2009

(65) Prior Publication Data

US 2010/0225376 A1 Sep. 9, 2010

(30) Foreign Application Priority Data

Mar. 3, 2009 (JP) ..... 2009-049206

(51) Int. Cl.
*H01P 1/15* (2006.01)
*H01P 5/18* (2006.01)

(52) U.S. Cl. ..... 333/103; 333/109

(58) Field of Classification Search ..... 333/101, 333/103, 104, 109, 116
See application file for complete search history.

(56) References Cited

U.S. PATENT DOCUMENTS 5,023,935 A * 6/1991 Vancraeynest ..... 455/80
5,363,071 A * 11/1994 Schwent et al. ..... 333/111
7,026,887 B2 * 4/2006 Watanabe et al. ..... 333/126
7,375,603 B2 * 5/2008 Dupont et al. ..... 333/24 R

FOREIGN PATENT DOCUMENTS

JP 2002-164703 A 7/2002
JP 2007-6433 A 11/2007

* cited by examiner

*Primary Examiner* — Dean O Takaoka
(74) *Attorney, Agent, or Firm* — Leydig, Voit & Mayer, Ltd.

(57) ABSTRACT

A semiconductor switch for switching a signal according to input power and maintaining performance of a receiver system with a simple configuration. The semiconductor switch comprises: a first FET connected between a first input/output terminal and a second input/output terminal; a first transmission line connected between the first input/output terminal and a third input/output terminal; a second transmission line parallel to the first transmission line; and a detector circuit connected to one end of the second transmission line, for outputting a DC voltage corresponding to power level of the high frequency signal, branched by the second transmission line. The first FET is controlled and switched according to an output from the detector circuit to switch between a route from the first input/output terminal to the second input/output terminal and a route from the first input/output terminal to the third input/output terminal.

16 Claims, 12 Drawing Sheets

SEMICONDUCTOR SWITCH, SEMICONDUCTOR SWITCH MMIC, CHANGEOVER SWITCH RF MODULE, POWER RESISTANCE SWITCH RF MODULE, AND TRANSMITTER AND RECEIVER MODULE

BACKGROUND OF THE INVENTION

1. Field of the Invention

The present invention relates to a semiconductor switch such as an RF signal changeover switch or a power resistance switch that mainly operates in a microwave band (300 MHz to 30 GHz) or a millimeter band (30 GHz to 300 GHz), and an MMIC and a module that use the semiconductor switch.

2. Description of the Related Art

In general, a high frequency semiconductor switch is used as a changeover switch of a desired RF signal, such as changeover between transmission and reception, in an RF module that operates in the microwave band or the millimeter band. Further, the high frequency semiconductor switch is used as a power resistance switch for a receiver system for protecting a receiver module, for example, a low-noise amplifier or the like when a signal of high input power is received.

Hereinafter, a conventional semiconductor switch is described with reference to the accompanying drawings.

FIG. 19 is a circuit diagram illustrating a conventional semiconductor switch 50.

Referring to FIG. 19, the semiconductor switch 50 includes a first input/output terminal P1, a second input/output terminal P2, and a third input/output terminal P3. A first field effect transistor (FET) 51 is connected between the first input/output terminal P1 and the second input/output terminal P2. Further, an inductor 52 is connected in parallel between a drain electrode and a source electrode of the first FET 51.

A transmission line 53 having a length of ¼ wavelength with respect to a desired RF signal is connected between the first input/output terminal P1 and the third input/output terminal P3. Further, one of the drain electrode and the source electrode of a second FET 54 is connected between the transmission line 53 and the third input/output terminal P3, and another of the drain electrode and the source electrode is grounded. Further, the gate electrodes of the first FET 51 and the second FET 54 are connected to a control voltage application terminal V1 through gate bias resistors 55 and 56, respectively (for example, refer to JP 2002-164703 A).

FIG. 20 is a circuit diagram illustrating an RF module for a case in which the semiconductor switch 50 illustrated in FIG. 19 is used as a changeover switch.

Referring to FIG. 20, the first input/output terminal P1 of the semiconductor switch 50 is connected to an antenna connection terminal P4. Further, the second input/output terminal P2 is connected to a receiver signal output terminal P5 through a receiver system circuit 57 (low noise amplifier or the like). Further, the third input/output terminal P3 is connected to a transmitter signal input terminal P6 through a transmitter system circuit 58 (amplifier or the like).

In the RF module, at the time of transmission, the semiconductor switch 50 is changed over to connect the first input/output terminal P1 and the third input/output terminal P3, and a transmitter signal input from the transmitter signal input terminal P6 is amplified by the transmitter system circuit 58 and output to the antenna connection terminal P4. On the other hand, at the time of reception, the semiconductor switch 50 is changed over to connect the first input/output terminal P1 and the second input/output terminal P2, and an input signal from the antenna connection terminal P4 is amplified by the receiver system circuit 57 and output to the receiver signal output terminal P5.

FIG. 21 is a circuit diagram illustrating an RF module for a case in which the semiconductor switch 50 illustrated in FIG. 19 is used as a power resistance switch.

Referring to FIG. 21, the first input/output terminal P1 of the semiconductor switch 50 is connected to the antenna connection terminal P4 through a circulator 59. The circulator 59 is connected to the transmitter signal input terminal P6 through the transmitter system circuit 58. The second input/output terminal P2 is connected to the receiver signal output terminal P5 through the receiver system circuit 57. The third input/output terminal P3 is grounded through a resistor 60.

In the RF module, at the time of transmission, the transmitter signal input from the transmitter signal input terminal P6 is amplified by the transmitter system circuit 58, and output to the antenna connection terminal P4 through the circulator 59. On the other hand, at the time of reception, the semiconductor switch 50 is changed over to connect the first input/output terminal P1 and the second input/output terminal P2, and the input signal from the antenna connection terminal P4 is amplified by the receiver system circuit 57 and output to the receiver signal output terminal P5.

In this example, when the input signal received by the antenna connection terminal P4 is of high input power, the semiconductor switch 50 is changed over to connect the first input/output terminal P1 and the third input/output terminal P3, and the input signal is allowed to pass through the resistor 60 serving as a dummy, thereby protecting the receiver system circuit 57.

However, the conventional art suffers from the following problems.

In the conventional semiconductor switch, when the switch is used as a power resistance switch of the RF module, it is necessary to detect a power level of the input signal at the time of reception and change over the semiconductor switch according to the power level. For that reason, it is necessary to provide a detector circuit for detecting the power level at the input side of the receiver system, which leads to such a problem that the performance is deteriorated with an increase in the loss of the receiver system.

Further, in addition to the above-mentioned detector circuit, a control circuit that controls the switching operation of the semiconductor switch is also required, resulting in such a problem that the circuit configuration is upsized.

Further, as another method, it is conceivable to provide a limiter or the like that reduces an excessive input power down to a constant level, at an input side of the receiver system. However, in this case, similarly, there arises such a problem that the performance is deteriorated with an increase in the loss of the receiver system.

SUMMARY OF THE INVENTION

The present invention has been made to solve the above-mentioned problems, and therefore has an object to provide a semiconductor switch which is capable of changing over a signal according to an input power at the time of reception while keeping the performance of the receiver system with a simple configuration.

According to the present invention, a semiconductor switch including a first input/output terminal, a second input/output terminal, and a third input/output terminal, wherein, the first input/output terminal and the second input/output terminal being connected by a first route, and the first input/output terminal and the third input/output terminal being connected by a second route, comprising: a first transistor connected in one of series and parallel between the first input/output terminal and the second input/output terminal; a first transmission line having a given length and connected between the first input/output terminal and the third input/output terminal; a second transmission line arranged in parallel to the first transmission line, for allowing a part of a high frequency signal passing through the first transmission line to be branched by coupling; and a detector circuit connected to one end of the second transmission line, for outputting a DC voltage corresponding to a power level of the branched high frequency signal, in which the first transistor is controlled and switched according to an output from the detector circuit to change over between the first route and the second route.

According to the semiconductor switch of the present invention, the first transistor is controlled and switched according to an output from the detector circuit that outputs a DC voltage corresponding to a power level of a high frequency signal, thereby changing over between the first route and the second route.

Therefore, there can be obtained the semiconductor switch capable of changing over a signal according to an input power at the time of reception while keeping the performance of the receiver system with a simple configuration.

DETAILED DESCRIPTION OF THE PREFERRED EMBODIMENTS

Figure 1:
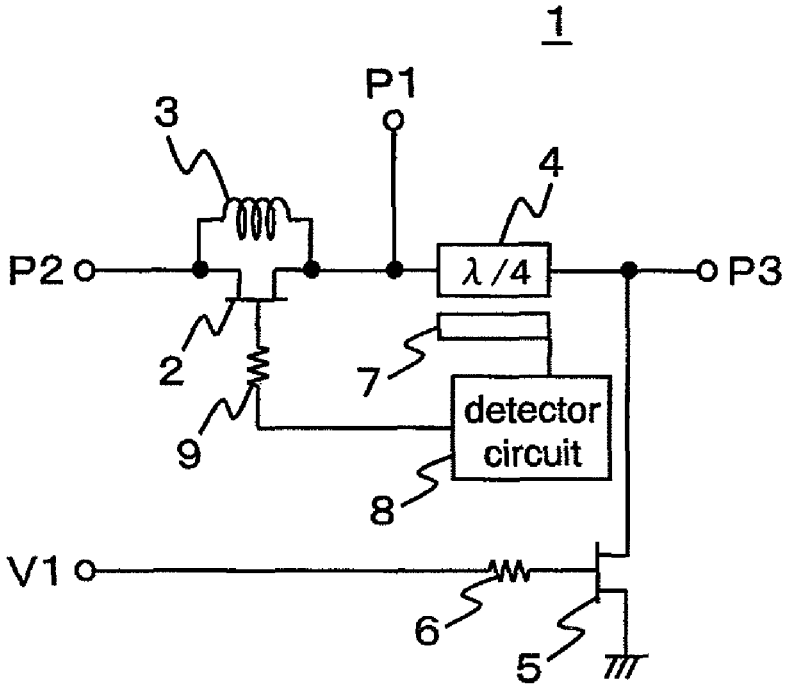
FIG. 1 is a circuit diagram illustrating a semiconductor switch according to a first embodiment of the present invention.

Hereinafter, with reference to the accompanying drawings, a description is given of respective embodiments of the present invention. In the respective drawings, identical or corresponding parts are denoted by the same reference numerals and symbols for description.

A semiconductor switch according to the present invention is formed on a semi-insulating substrate, and used as a semiconductor switch microwave monolithic IC (MMIC). Further, the semiconductor switch and the semiconductor switch MMIC are used as parts constituting a changeover switch RF module, a power resistance switch RF module, and a transmitter and receiver module.

First Embodiment

FIG. 1 is a circuit diagram illustrating a semiconductor switch 1 according to a first embodiment of the present invention.

Referring to FIG. 1, the semiconductor switch 1 includes a first input/output terminal P1, a second input/output terminal P2, and a third input/output terminal P3. A first field effect transistor (FET) 2 (first transistor) used as a switching element is connected between the first input/output terminal P1 and the second input/output terminal P2. Further, an inductor 3 is connected in parallel between a drain electrode and a source electrode of the first FET 2. Any one of the drain electrode and the source electrode of the first FET 2 may be at the first input/output terminal P1 side.

A transmission line 4 (first transmission line) having a length of ¼ wavelength with respect to a desired RF signal is connected between the first input/output terminal P1 and the third input/output terminal P3. Further, one of a drain electrode and a source electrode of a second FET 5 (second transistor) used as the switching element is connected between the transmission line 4 and the third input/output terminal P3, and another of the drain electrode and the source electrode is grounded. Further, a gate electrode of the second FET 5 is connected to a control voltage application terminal V1 through a gate bias resistor 6. Any one of the drain electrode and the source electrode of the second FET 5 may be at the third input/output terminal P3 side.

An n-channel junction FET (J-FET) or an n-channel depletion metal oxide semiconductor FET (MOS-FET) is used as the first FET 2 and the second FET 5. Those FETs have a property that no current flows between the drain and the source when a gate voltage is lower than a pinch-off voltage Vp, and a current more easily flows between the drain and the source as the gate voltage is higher when the gate voltage is higher than the pinch-off voltage Vp. In the n-channel FET, Vp is a negative voltage.

Further, a transmission line 7 (second transmission line) is disposed in the transmission line 4 so as to be disposed in parallel to the transmission line 4, and to branch a part of the RF signal that passes through the transmission line 4 by electromagnetic coupling. A detector circuit 8 that detects a power level of the branched RF signal and outputs a negative DC voltage Vmnt according to the power level is connected to an end of the transmission line 7 at the second FET 5 side. The detector circuit 8 outputs a negative DC voltage that is larger in absolute value as the power level is higher. Further, an output of the detector circuit 8 is connected to a gate electrode of the first FET 2 through a gate bias resistor 9.

Figure 2A:
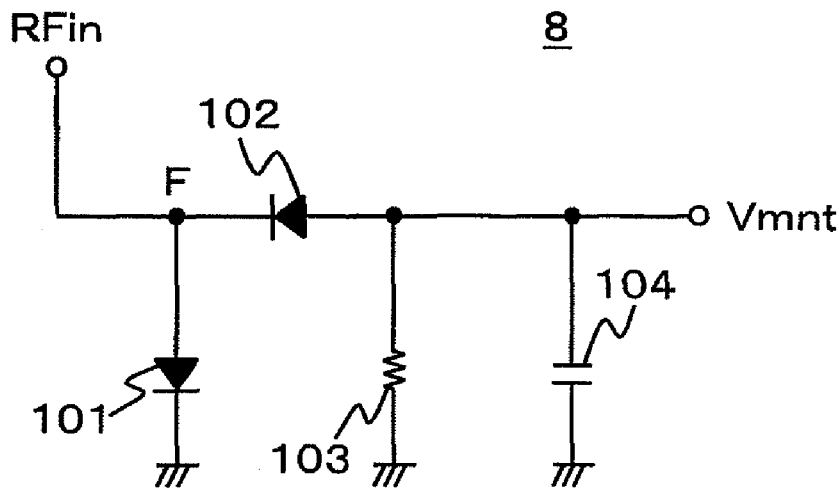
FIGS. 2A and 2B are circuit diagrams illustrating a detector circuit in the semiconductor switch of FIG. 1, respectively.

FIG. 2A is a circuit diagram illustrating the detector circuit 8 in the semiconductor switch 1 of FIG. 1.

Referring to FIG. 2A, the detector circuit 8 includes diodes 101 and 102, a resistor 103, and a capacitor 104. A terminal RFin is connected with an anode of the diode 101 and a cathode of the diode 102. It is assumed that a connection point between the anode of the diode 101 and the cathode of the diode 102 is a connection point F. A cathode of the diode 101 is grounded. An anode of the diode 102 is connected to one end of the resistor 103, to one end of the capacitor 104, and to a terminal Vmnt. Another end of the resistor 103 and another end of the capacitor 104 are grounded, respectively.

The amplitude of the RF signal which has been input from the transmission line 7 to the RF input terminal RFin is output as the negative DC voltage Vmnt due to the rectifying action of the diodes 101 and 102 and the smoothing action of the resistor 103 and the capacitor 104.

Hereinafter, an operation of the semiconductor switch 1 configured as described above is described.

Figure 3:
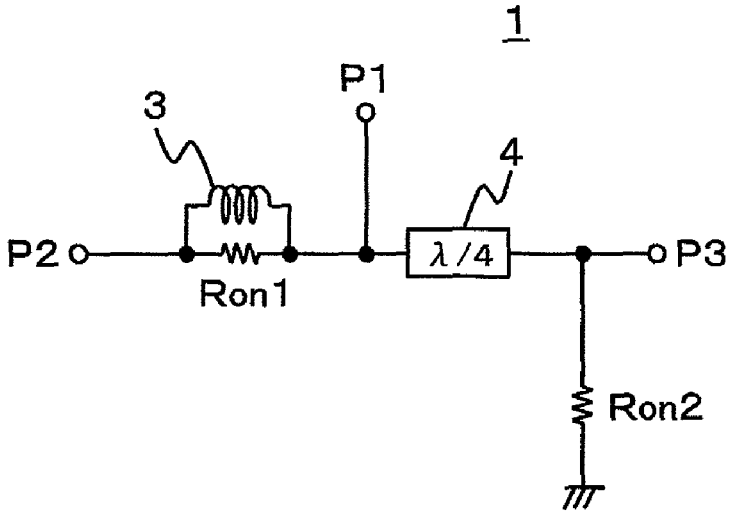
FIG. 3 is a circuit diagram illustrating an equivalent circuit of the semiconductor switch of FIG. 1 when 0 V is applied to a control voltage application terminal, and a power level of an RF signal branched by a transmission line is low.

FIG. 3 illustrates an equivalent circuit of the semiconductor switch 1 of FIG. 1 when a voltage (for example, 0 V) higher than a pinch-off voltage Vp2 of the second FET 5 is applied to the control voltage application terminal V1, and the power level of the RF signal input to the first input/output terminal P1 and branched by the transmission line 7 is low. In FIG. 3, the gate voltage of the second FET 5 is higher than the pinch-off voltage Vp2 of the second FET 5, whereby the second FET 5 becomes an on-resistance (resistance value when the transistor is on) Ron2. For that reason, the transmission line 4 functions as a short stub of $\lambda/4$, and the impedance at the third input/output terminal P3 side viewed from the first input/output terminal P1 becomes a high impedance.

Further, the power level of the RF signal branched by the transmission line 7 is low, and hence the DC voltage Vmnt output from the detector circuit 8 is higher than a pinch-off voltage Vp1 of the first FET 2 (Vp1<Vmnt), and the first FET 2 is an on-resistance Ron1. For that reason, the impedance at the second input/output terminal P2 side viewed from the first input/output terminal P1 is regarded as substantially Ron1 to provide a low impedance, and the RF signal input to the first input/output terminal P1 is output from the second input/output terminal P2.

Figure 4:
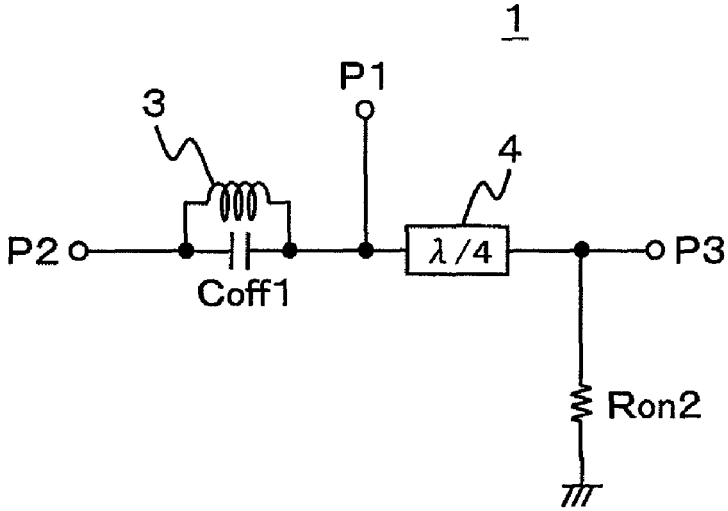
FIG. 4 is a circuit diagram illustrating an equivalent circuit of the semiconductor switch of FIG. 1 when 0 V is applied to the control voltage application terminal, and the power level of the RF signal branched by the transmission line is high.
Figure 21:
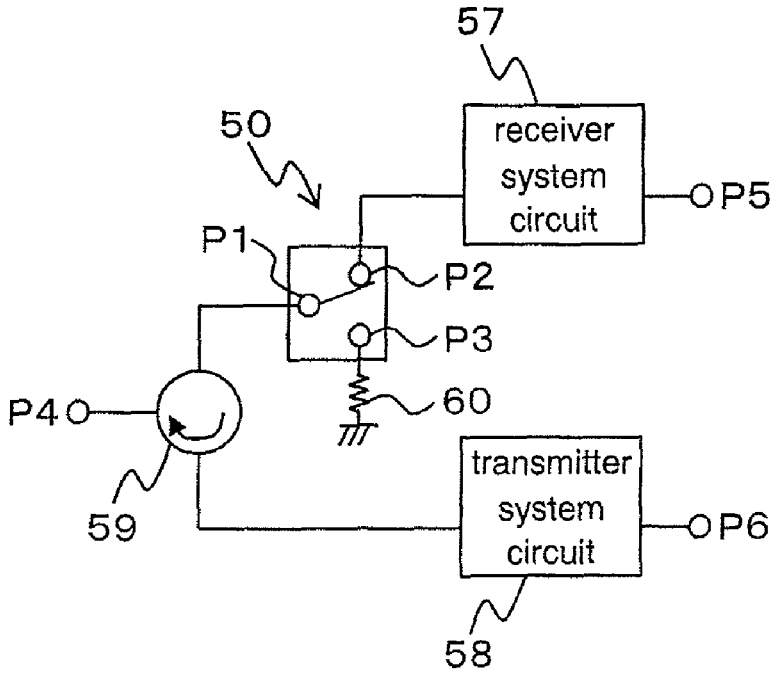
FIG.21 PRIOR ART
FIG. 21 is a circuit diagram illustrating an RF module when the semiconductor switch of FIG. 19 is used as a power resistance switch.

FIG. 4 illustrates an equivalent circuit of the semiconductor switch 1 when a voltage higher than the pinch-off voltage Vp2 of the second FET 5 is applied to the control voltage application terminal V1, and the power level of the RF signal branched by the transmission line 7 is high. In this case, the DC voltage Vmnt output from the detector circuit 8 is lower than the pinch-off voltage Vp1 of the first FET 2 (Vp1>Vmnt), and the first FET 2 is an off-capacitance (capacitance when the transistor is off) Coff1. In order to make the impedance higher than that of the single first FET 2 being off, the inductor 3 has an inductance value that resonates with the off-capacitance Coff1 of the first FET 2 at a desired frequency. With resonance of the off-capacitance Coff1 with the inductor 3, the impedance at the second input/output terminal P2 side viewed from the first input/output terminal P1 is higher than the impedance at the third input/output terminal P3 side viewed from the first input/output terminal P1. As a result, the RF signal from the first input/output terminal P1 to the second input/output terminal P2 is blocked, and the RF signal input to the first input/output terminal P1 is output from the third input/output terminal P3, and passes through a dummy resistor (refer to FIG. 21). Accordingly, when the RF signal input to the first input/output terminal P1 is a high input power, a receiver system circuit (refer to FIG. 21) connected to the second input/output terminal P2 can be protected.

When a voltage (for example, −5 V when Vp2 is −2 V) lower than the pinch-off voltage Vp2 of the second FET 5 is applied to the control voltage application terminal V1, the second FET 5 is an off-capacitance Coff2, and the transmission line 4 functions as the normal transmission line. For that reason, the impedance at the third input/output terminal P3 side viewed from the first input/output terminal P1 is low. Similarly, in this case, when the power level of the RF signal input to the first input/output terminal P1 and branched by the transmission line 7 becomes high, the first FET 2 changes from the on-resistance Ron1 to the off-capacitance Coff1. Then, the off-capacitance Coff1 and the inductor 3 resonate with each other, thereby making high the impedance at the second input/output terminal P2 side viewed from the first input/output terminal P1 so as to protect the receiver system circuit (refer to FIG. 21) connected to the second input/output terminal P2.

Figure 5:
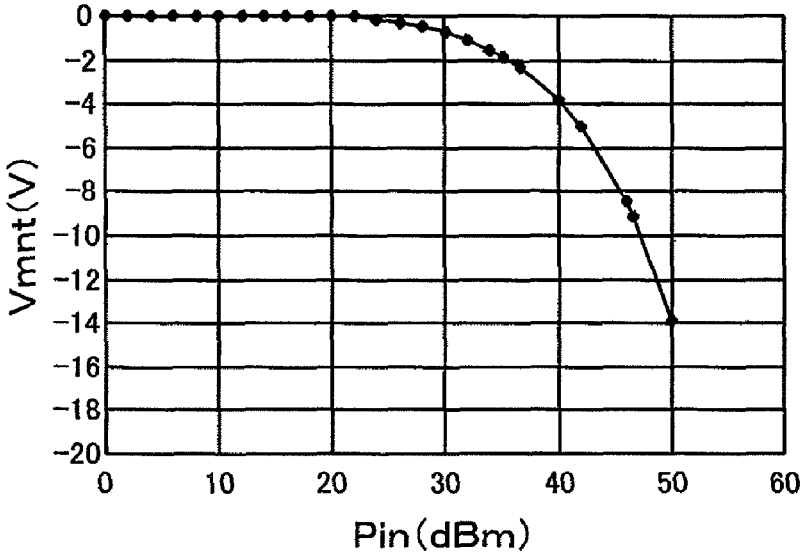
FIG. 5 is an explanatory diagram illustrating an example of calculation results of a DC voltage from the detector circuit with respect to the power level of the RF signal input to a first input/output terminal in the semiconductor switch of FIG. 1.

FIG. 5 illustrates an example of calculation results of the DC voltage Vmnt output from the detector circuit 8 with respect to the power level of the RF signal input to the first input/output terminal P1 in the semiconductor switch 1. The calculation is conducted when it is assumed that a length of the transmission line 4 is 4 mm, a width thereof is 70 μm, a length of the transmission line 7 is 4 mm, a width thereof is 20 μm, and a gap between those transmission lines 4 and 7 is 10 μm.

From FIG. 5, it is understood that, under the condition described above, in the case where the pinch-off voltage Vp1 of the first FET 2 is, for example, −2 V, the RF signal from the first input/output terminal P1 to the second input/output terminal P2 is blocked when the power level of the RF signal is equal to or higher than about 35 dBm.

According to the semiconductor switch according to the first embodiment of the present invention, the first transistor is connected in series between the first input/output terminal and the second input/output terminal. The inductor is connected in parallel between the source electrode and the drain electrode of the first transistor. The detector circuit detects the power level of the high frequency signal branched from the transmission line inserted between the first input/output terminal and the third input/output terminal, and outputs the negative DC voltage corresponding to the power level to the gate electrode of the first transistor. For that reason, the semiconductor switch which has a circuit for detecting the power level of the RF signal therein, and has a function for protecting the receiver circuit according to the power of the RF signal can be configured by one chip like an MMIC, and is readily downsized. Further, there can be obtained the semiconductor switch capable of changing over the signal according to the input power at the time of reception while keeping the performance of the receiver system with a simple configuration.

In the above-mentioned first embodiment, the n-channel FETs are exemplified. When elements in the circuit, the detected output voltage, and the polarity of the control voltage are appropriately changed, p-channel FETs can be also used. Similarly, even when GaAs-FETs, GaN-FETs, or the like are used as FETs, the same advantages can be obtained.

Further, in the above-mentioned first embodiment, the transmission line 4 has a length of ¼ wavelength with respect to the desired RF signal. However, the line length of the transmission line 4 is not limited to this configuration. That is, the line length and line width of the transmission line 4 is for converting the impedance at the third input/output terminal P3 side viewed from the first input/output terminal P1 into a high impedance at the time of blocking, and therefore the length is not necessarily ¼ wavelength, and can be adjusted in a desired band. Further, the line length of the transmission line 4 can be set to (1+2n)/4 wavelength (n is an integer of 1 or more). The inductor 3 may be a transmission line that resonates with the off-capacitance of the first FET 2.

Those features can be applied to the following embodiments, and their modified examples, likewise.

First Modified Example of the First Embodiment

In the above-mentioned first embodiment, the detector circuit 8 is connected to the end of the transmission line 7 at the second FET 5 side. However, the present invention is not limited to the above-mentioned configuration.

Figure 6:
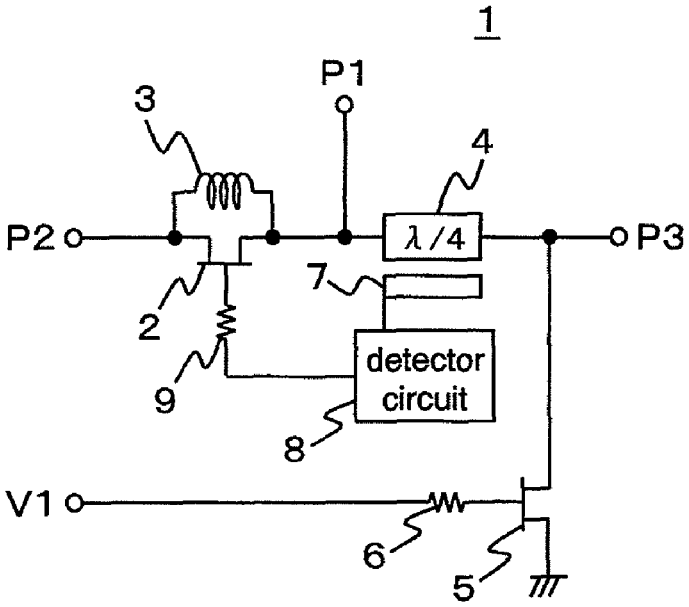
FIG. 6 is a circuit diagram illustrating a semiconductor switch according to a first modified example of the first embodiment of the present invention.

FIG. 6 is a circuit diagram illustrating a semiconductor switch 1 according to a first modified example of the first embodiment of the present invention.

Referring to FIG. 6, the detector circuit 8 is connected to an end of the transmission line 7 at the first FET 2 side. Other configurations are identical with those of FIG. 1, and therefore their description is omitted.

Figure 7:
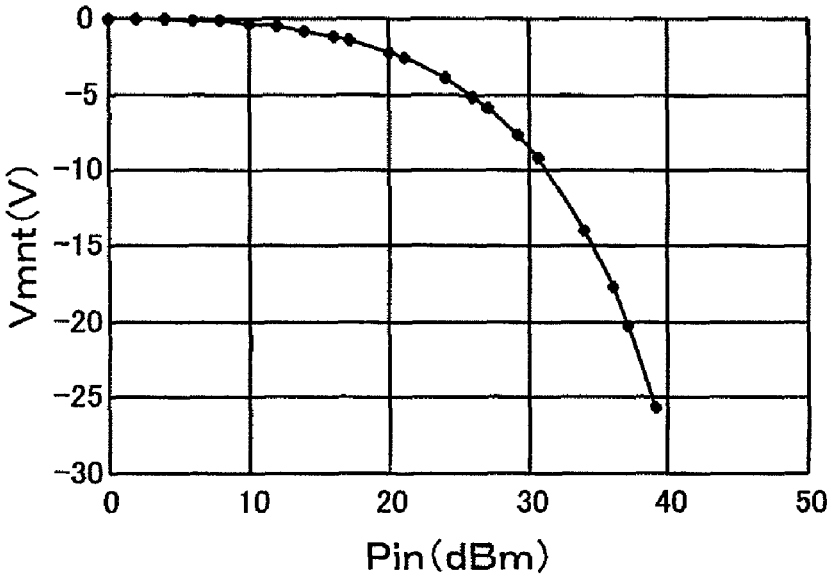
FIG. 7 is an explanatory diagram illustrating an example of calculation results of a DC voltage from a detector circuit with respect to a power level of an RF signal input to a first input/output terminal in the semiconductor switch of FIG. 6.

The detector circuit 8 is connected to the end of the transmission line 7 at the first FET 2 side, thereby making it possible to reduce the power level for blocking the RF signal from the first input/output terminal P1 to the second input/output terminal P2. FIG. 7 illustrates an example of calculation results of the DC voltage Vmnt output from the detector circuit 8 with respect to the power level of the RF signal which is input to the first input/output terminal P1 in the semiconductor switch 1 illustrated in FIG. 6. The dimensions of the transmission line 4 and the transmission line 7 and the gap therebetween are the same values as in the case of the calculation of FIG. 5.

It is found from FIG. 7 that, under the condition described above, in the case where the pinch-off voltage Vp1 of the first FET 2 is, for example, −2 V, the RF signal from the first input/output terminal P1 to the second input/output terminal P2 is blocked when the power level of the RF signal is equal to or higher than about 20 dBm. That is, the RF signal from the first input/output terminal P1 to the second input/output terminal P2 can be blocked at an RF signal level lower than that of FIG. 5.

The above-mentioned modification can be applied similarly to the following embodiments and modified examples thereof.

Second Modified Example of First Embodiment

Figure 2B:
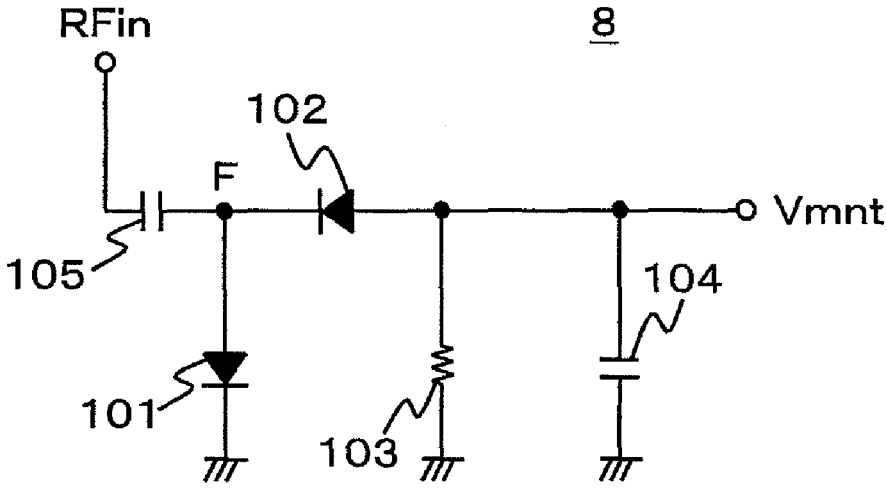

In the above-mentioned first embodiment, the detector circuit 8 is configured by the rectifier circuit illustrated in FIG. 2A. Alternatively, in order to extract a higher detected output voltage, a voltage doubler rectifier circuit may be applied. For example, as illustrated in FIG. 2B, a capacitor 105 is connected between the terminal RFin and the connection point F, thereby enabling a half-wave voltage doubler rectifier circuit. Further, another voltage doubler rectifier circuit such as a full-wave voltage doubler rectifier circuit can be applied. With use of the voltage doubler rectifier circuit, it is possible to extract a detected output voltage higher than the maximum amplitude of the RF signal in the transmission line 4. This enables the receiver circuit to be protected at the lower RF signal level, and protection operation to be more stabilized.

The above-mentioned modification can be applied to the first embodiment and the first modified example of the first embodiment. The above-mentioned modification can be applied to the following embodiments and modified examples thereof, likewise.

Second Embodiment

Figure 8:
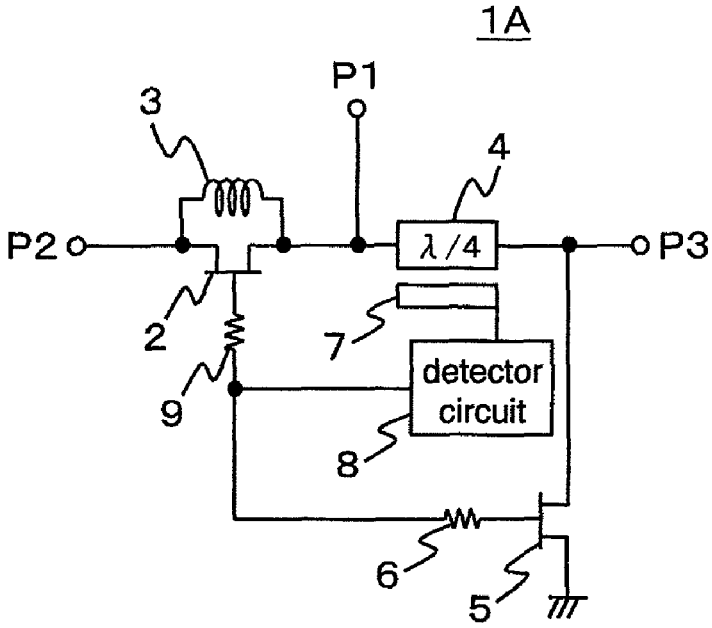
FIG. 8 is a circuit diagram illustrating a semiconductor switch according to a second embodiment of the present invention.

FIG. 8 is a circuit diagram illustrating a semiconductor switch 1A according to a second embodiment of the present invention.

Referring to FIG. 8, the output of the detector circuit 8 is connected to the gate electrode of the first FET 2, and also to the gate electrode of the second FET 5. The circuit has no control voltage application terminal. Other configurations are identical with those of FIG. 1, and their description is omitted.

Hereinafter, an operation of the semiconductor switch 1A configured as described above is described.

When the power level of the RF signal which has been branched by the transmission line 7 is low, the DC voltage Vmnt output from the detector circuit 8 is higher than the pinch-off voltage Vp1 of the first FET 2 and the pinch-off voltage Vp2 of the second FET 5 (Vp1, Vp2<Vmnt). For that reason, an equivalent circuit is the same as the circuit of FIG. 3, and the RF signal input to the first input/output terminal P1 is output from the second input/output terminal P2.

Figure 9:
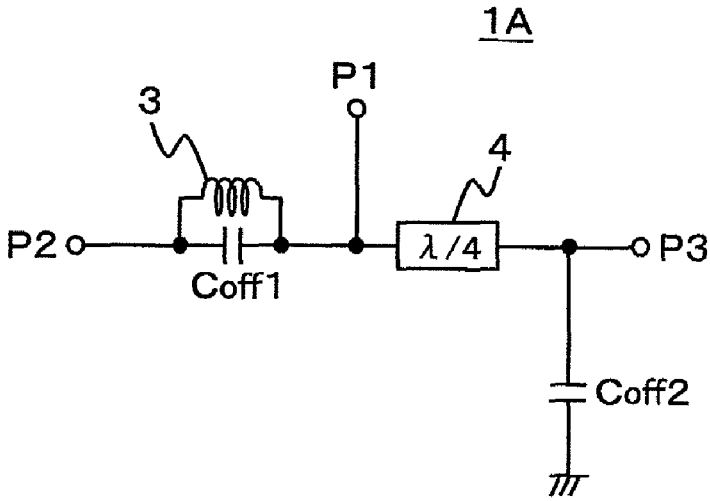
FIG. 9 is a circuit diagram illustrating an equivalent circuit of the semiconductor switch of FIG. 8 when an RF signal input to a first input/output terminal is a high input power.

When the power level of the RF signal branched by the transmission line 7 becomes high, the DC voltage Vmnt output from the detector circuit 8 is lower than the pinch-off voltage Vp1 of the first FET 2 and the pinch-off voltage Vp2 of the second FET 5 (Vp1, Vp2>Vmnt). For that reason, the first FET 2 and the second FET 5 become the off-capacitance Coff1 and the off-capacitance Coff2, respectively. An equivalent circuit of the semiconductor switch 1A in this case is illustrated in FIG. 9.

In this case, when the off-capacitance Coff1 and the inductor 3 resonate with each other, the impedance at the second input/output terminal P2 side viewed from the first input/output terminal P1 becomes high, and the RF signal from the first input/output terminal P1 to the second input/output terminal P2 is blocked. The second FET 5 has the off-capacitance Coff2, and hence the RF signal input to the first input/output terminal P1 is output from the third input/output terminal P3, and passes through the dummy resistor (refer to FIG. 21).

In the semiconductor switch according to the second embodiment of the present invention, the first transistor is connected in series between the first input/output terminal and the second input/output terminal. Further, the inductor is connected in parallel between the source electrode and the drain electrode of the first transistor. Further, the detector circuit detects the power level of the high frequency signal branched from the transmission line which is inserted between the first input/output terminal and the third input/output terminal, and outputs the negative DC voltage corresponding to the power level to the gate electrode of the first transistor and the gate electrode of the second transistor.

For that reason, there can be provided the semiconductor switch which is easily downsized and is capable of changing over the signal according to the input power at the time of reception while keeping the performance of the receiver system with a simple configuration, thereby protecting the receiver circuit.

First Modified Example of Second Embodiment

Figure 10:
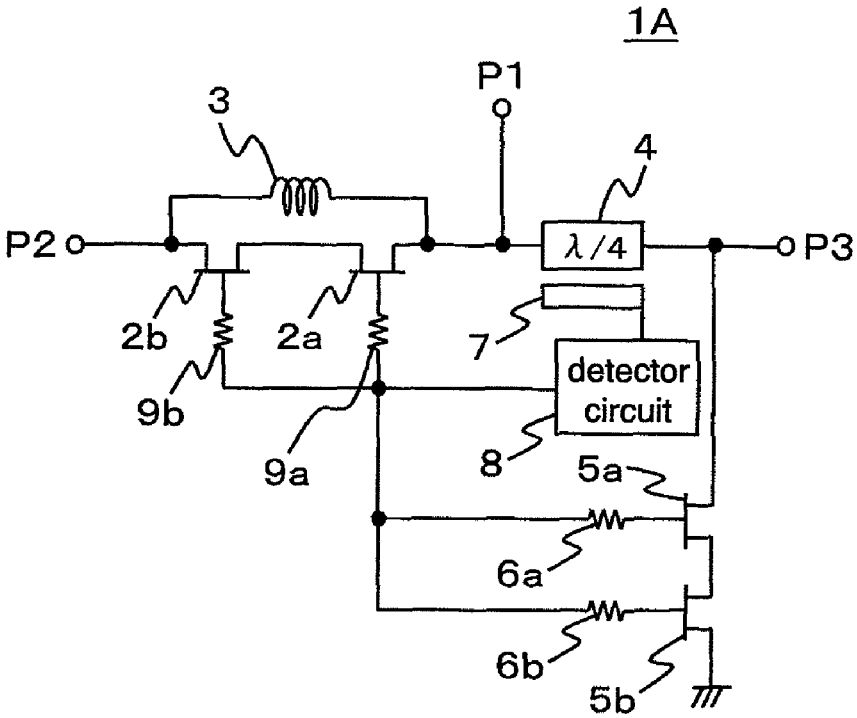
FIG. 10 is a circuit diagram illustrating a semiconductor switch according to a first modified example of the second embodiment of the present invention.
Figure 11:
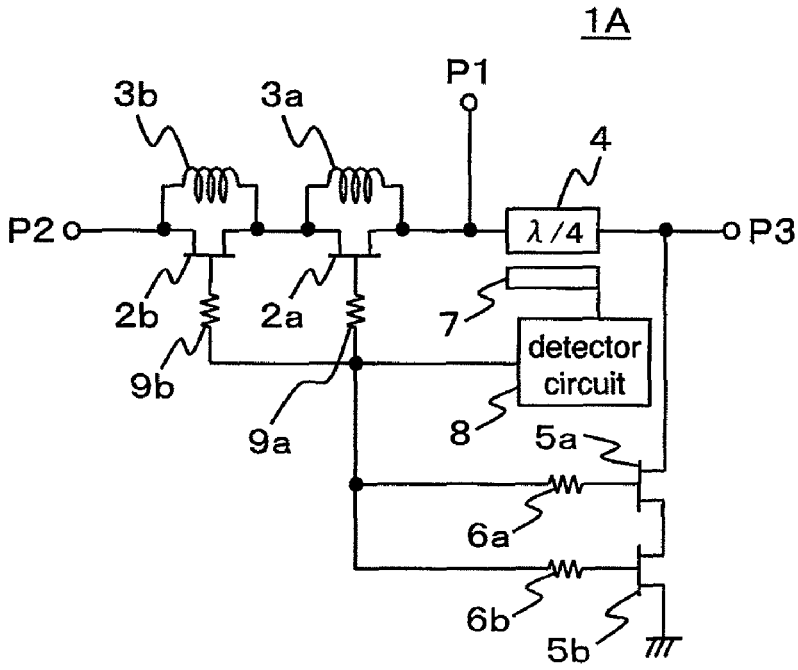
FIG. 11 is a circuit diagram illustrating a semiconductor switch according to a second modified example of the second embodiment of the present invention.

FIG. 10 is a circuit diagram illustrating a configuration in which a plurality of first FETs 2 and a plurality of second FETs 5 are connected in series, respectively, in the semiconductor switch 1A illustrated in FIG. 8.

Referring to FIG. 10, two first FETs 2*a* and 2*b* are connected in series between the first input/output terminal P1 and the second input/output terminal P2. Further, two second FETs 5*a* and 5*b* are connected in series between the transmission line 4 and the third input/output terminal P3. Other configurations are identical with those of FIG. 8, and therefore their description is omitted.

In this case, a power (current, voltage) applied to each of the plurality of first FETs 2*a* and 2*b*, and the plurality of second FETs 5*a* and 5*b* can be dispersed with respect to the high input power, and hence it is possible to deal with the RF signal with the higher power.

Second Modified Example of Second Embodiment

When the plurality of first FETs 2*a* and 2*b* are connected as in the above-mentioned first modified example of the second embodiment, inductors 3*a* and 3*b* can be connected between drains and sources of the plurality of first FETs 2*a* and 2*b*, respectively. With the above-mentioned configuration, a plurality of resonator circuits including the first FETs 2*a* and 2*b* and the inductors 3*a* and 3*b* are connected in series, thereby enabling isolation to be more enhanced.

Third Modified Example of Second Embodiment

A circuit dealing with a further larger input power can be configured by a plurality of first FETs 2 and a plurality of second FETs 5.

Figure 12:
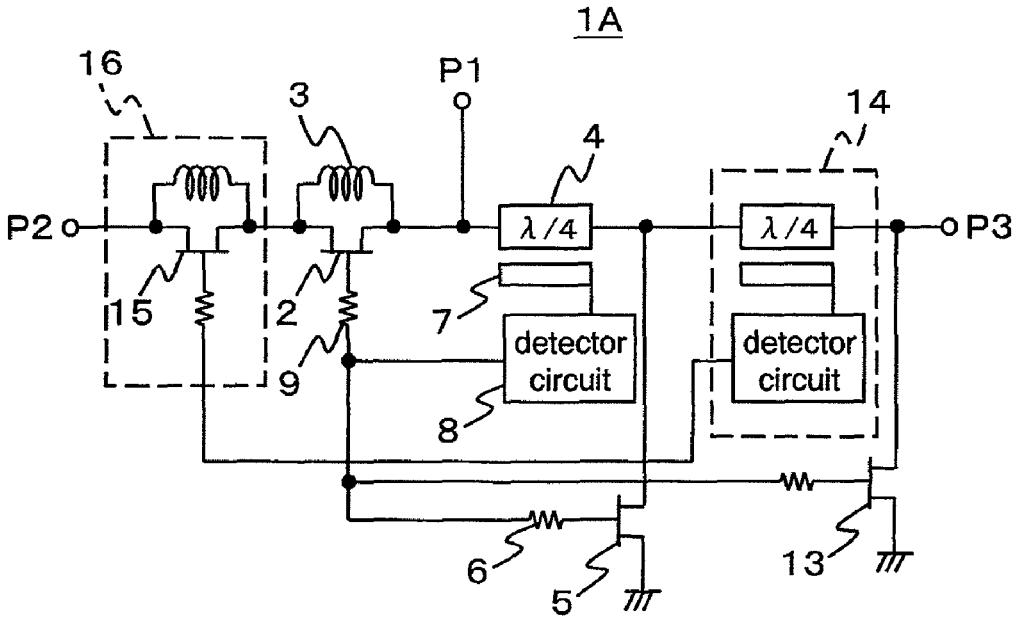
FIG. 12 is a circuit diagram illustrating a semiconductor switch according to a third modified example of the second embodiment of the present invention.

FIG. 12 is a circuit diagram illustrating another configuration in which a plurality of first FETs 2 and a plurality of second FETs 5 are disposed in the semiconductor switch 1A illustrated in FIG. 8.

Referring to FIG. 12, a third FET 13 is connected in parallel to the second FET 5 between the second FET 5 and the third input/output terminal P3. Further, a detector circuit 14 having the identical configuration with that of FIG. 8 is connected between the second FET 5 and the third FET 13. A resonator circuit 16 made up of a fourth FET 15 and an inductor is connected in series with the first FET 2 between the first FET 2 and the second input/output terminal P2. A gate electrode of the third FET 13 is connected to the output of the detector circuit 8 through a gate bias resistor. An output of the detector circuit 14 is connected to a gate electrode of the fourth FET 15. Other configurations are identical with those of FIG. 8, and therefore their description is omitted.

Hereinafter, an operation of the semiconductor switch 1A configured as described above is described.

When the RF signal input to the first input/output terminal P1 is a large input power, the first FET 2, the second FET 5, and the third FET 13 are of the off-capacitance, respectively, by the negative DC voltage Vmnt output from the detector circuit 8. For that reason, the RF signal connected from the first input/output terminal P1 to the second input/output terminal P2 changes to that connected from the first input/output terminal P1 to the third input/output terminal P3. In this situation, the negative DC voltage Vmnt lower than the pinch-off voltage output from the detector circuit 14 is applied to the gate electrode of the fourth FET 15 of the resonator circuit 16, thereby making the resonator circuit 16 high in impedance, whereby isolation is taken by two resonator circuits. Therefore, isolation to the second input/output terminal P2 can be further improved.

Also in embodiments or modified examples thereof other than the second embodiment, a plurality of first FETs 2 and a plurality of second FETs 5 may be disposed as in the above-mentioned first to third modified examples, without limitation to the configuration in which one first FET 2 and one second FET 5 are disposed.

Third Embodiment

Figure 13:
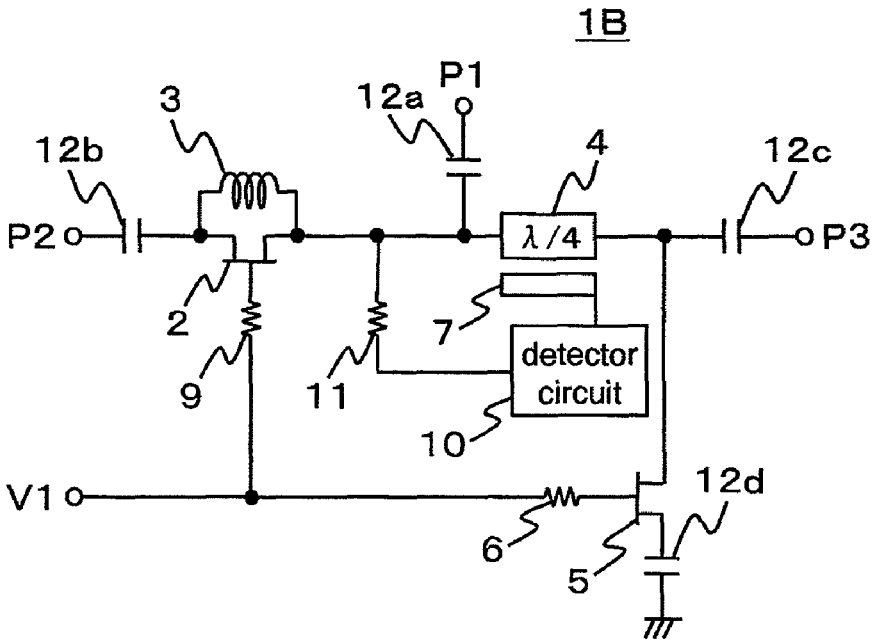
FIG. 13 is a circuit diagram illustrating a semiconductor switch according to a third embodiment of the present invention.

FIG. 13 is a circuit diagram illustrating a semiconductor switch 1B according to a third embodiment of the present invention.

Referring to FIG. 13, the semiconductor switch 1B is connected with a detector circuit 10 that detects a power level of the branched RF signal and outputs a positive DC voltage Vmnt corresponding to the power level instead of the detector circuit 8 illustrated in FIG. 1. The detector circuit 10 outputs the higher DC voltage as the power level is higher. The detector circuit 10 can be realized by changing the polarities of the diodes 101 and 102 of the detector circuit 8 illustrated in FIG. 2A. Further, an output of the detector circuit 10 is connected to a signal line between a DC cut capacitor 12*a* connected to the first input/output terminal P1 and the first FET 2 through a bias resistor 11.

Further, the gate electrode of the first FET 2 is connected to the control voltage application terminal V1 through the gate bias resistor 9. DC cut capacitors 12*b*, 12*c*, and 12*d* are connected to the second input/output terminal P2, to the third input/output terminal P3, and between the second FET 5 and the ground, respectively. Other configurations are identical with those of FIG. 1, and therefore their description is omitted.

Hereinafter, an operation of the semiconductor switch 1B configured as described above is described.

When a voltage higher than both of the pinch-off voltages Vp1 and Vp2 of the first FET 2 and the second FET 5 is applied to the control voltage application terminal V1, and the power level of the RF signal branched by the transmission line 7 is low, the first FET 2 and the second FET 5 become the on-resistance Ron1 and the on-resistance Ron2. For that reason, an equivalent circuit is identical with the circuit of FIG. 3, and the RF signal input to the first input/output terminal P1 is output from the second input/output terminal P2.

In this example, when the power level of the RF signal branched by the transmission line 7 becomes high, the signal line becomes positive potential by the DC voltage Vmnt output from the detector circuit 10, and the gate voltages of the first FET 2 and the second FET 5 are relatively lowered. As a result, the first FET 2 and the second FET 5 become the off-capacitance Coff1 and the off-capacitance Coff2, respectively. Accordingly, the equivalent circuit is identical with the circuit of FIG. 9, and the RF signal from the first input/output terminal P1 to the second input/output terminal P2 is blocked, and the RF signal input to the first input/output terminal P1 is output from the third input/output terminal P3, and passes through the dummy resistor (refer to FIG. 21).

In the semiconductor switch according to the third embodiment of the present invention, the first transistor is connected in series between the first input/output terminal and the second input/output terminal. Further, the inductor is connected in parallel between the source electrode and the drain electrode of the first transistor. Further, the detector circuit detects the power level of the high frequency signal branched from the transmission line which is inserted between the first input/output terminal and the third input/output terminal, and outputs the positive DC voltage corresponding to the power level to the signal line between the first input/output terminal and the first transistor.

For that reason, there can be obtained the semiconductor switch which is easily downsized, and is capable of changing over the signal according to the input power at the time of reception while keeping the performance of the receiver system with a simple configuration.

Further, when a voltage higher than the pinch-off voltages of the first FET and the second FET is applied to the control voltage application terminal, and the power level of the RF signal branched by the transmission line is high, the second FET is not turned off in the semiconductor switch according to the first embodiment. On the other hand, the second FET is turned off in the semiconductor switch according to the third embodiment, and the transmission line between the first input/output terminal and the third input/output terminal serves as a normal transmission line. Therefore, the impedance between the first input/output terminal and the third input/output terminal can be further reduced, and the receiver circuit protection capability at the time of reception is further increased.

Further, when a voltage lower than the pinch-off voltages of the first FET and the second FET is applied to the control voltage application terminal, and the power level of the RF signal branched by the transmission line is low, the RF signal from the first input/output terminal to the second input/output terminal is not blocked in the semiconductor switch according to the first embodiment. On the other hand, in the semiconductor switch according to the third embodiment, the RF signal from the first input/output terminal to the second input/output terminal is blocked, whereby it becomes more difficult to mix the RF signal into the receiver circuit at the time of transmission.

Fourth Embodiment

Figure 14:
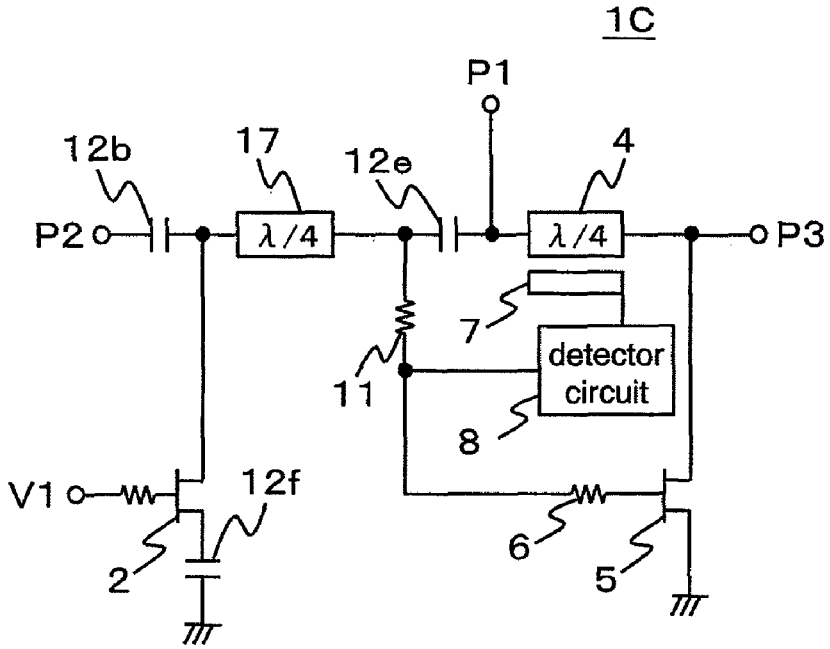
FIG. 14 is a circuit diagram illustrating a semiconductor switch according to a fourth embodiment of the present invention.

FIG. 14 is a circuit diagram illustrating a semiconductor switch 1C according to a fourth embodiment of the present invention. The semiconductor switch 1C is a parallel switch.

Referring to FIG. 14, a transmission line 17 (third transmission line) having a length of ¼ wavelength with respect to a desired RF signal is connected between the first input/output terminal P1 and the second input/output terminal P2 through the DC cut capacitors 12*b* and 12*e*. Further, the first FET 2 is connected in parallel between the transmission line 17 and the second input/output terminal P2. That is, one of the drain electrode and the source electrode of the first FET 2 is connected between the transmission line 17 and the second input/output terminal P2, and another of the drain electrode and source electrode is grounded through a DC cut capacitor 12*f*. The gate electrode of the first FET 2 is connected to the control voltage application terminal V1 through a gate bias resistor.

Further, the transmission line 4 is connected between the first input/output terminal P1 and the second input/output terminal P3, one of the drain electrode and source electrode of the second FET 5 is connected between the transmission line 4 and the third input/output terminal P3, and another of the drain electrode and source electrode is grounded.

The transmission line 7 arranged in parallel to the transmission line 4 is disposed in the transmission line 4. The detector circuit 8 that outputs the negative DC voltage Vmnt corresponding to the power level of the branched RF signal is connected to the end of the transmission line 7 at the second FET 5 side. The output of the detector circuit 8 is connected to a signal line between the DC cut capacitor 12*e* and the transmission line 17 through the bias resistor 11, and also connected to the gate electrode of the second FET 5 through the gate bias resistor 6.

Hereinafter, an operation of the semiconductor switch 1C configured as described above is described.

When a voltage satisfying V1<Vp1 is applied to the control voltage application terminal V1, and the power level of the RF signal branched by the transmission line 7 is low, the first FET 2 is of the off-capacitance, whereby the transmission line 17 serves as a normal transmission line, and the RF signal input to the first input/output terminal P1 at the time of reception is output from the second input/output terminal P2. In this situation, the second FET 5 becomes of on-resistance, and the impedance at the third input/output terminal P3 side viewed from the first input/output terminal P1 is high. As a result, the RF signal from the first input/output terminal P1 to the third input/output terminal P3 is blocked.

In this example, when V1<Vp1 is satisfied, and the power level of the RF signal branched by the transmission line 7 is high, the gate voltage becomes relatively high by the negative DC voltage Vmnt output from the detector circuit 8. As a result, the first FET 2 becomes of on-resistance, and the impedance at the second input/output terminal P2 side viewed from the first input/output terminal P1 becomes high. In this situation, the second FET 5 is of off-capacitance by the negative DC voltage Vmnt applied to the gate electrode of the second FET 5, whereby the RF signal from the first input/output terminal P1 to the second input/output terminal P2 is blocked, and the RF signal input to the first input/output terminal P1 is output from the third input/output terminal P3, and passes through the dummy resistor (refer to FIG. 21).

When a voltage satisfying V1>Vp1 is applied to the control voltage application terminal V1, and the power level of the RF signal branched by the transmission line 7 is low, the first FET 2 and the second FET 5 are of on-resistance, whereby all of the RF signal from the first input/output terminal P1 to the second input/output terminal P2, and the RF signal from the first input/output terminal P1 to the third input/output terminal P3 are blocked.

Further, when a voltage satisfying V1>Vp1 is applied to the control voltage application terminal V1, and the power level of the RF signal branched by the transmission line 7 is high, the first FET 2 is of on-resistance, and the second FET 5 is of off-capacitance. Therefore, the RF signal from the first input/output terminal P1 to the second input/output terminal P2 is blocked, and the RF signal input to the first input/output terminal P1 is output from the third input/output terminal P3, and passes through the dummy resistor (refer to FIG. 21).

As described above, when the power level of the RF signal branched by the transmission line 7 is high, the RF signal from the first input/output terminal P1 to the second input/output terminal P2 is blocked, and an impedance between the first input/output terminal P1 and the third input/output terminal P3 is low, not depending on the applied voltage of the control voltage application terminal V1. Therefore, the receiver circuit can be effectively protected.

In the semiconductor switch according to the fourth embodiment of the present invention, the third transmission line having a given length is connected in series between the first input/output terminal and the second input/output terminal. Further, one of the drain electrode and source electrode of the first transistor is connected in parallel between the second input/output terminal and the third transmission line, and another of the drain electrode and source electrode is grounded through the DC cut capacitor. Further, the detector circuit detects the power level of the high frequency signal branched from the transmission line which is inserted between the first input/output terminal and the third input/output terminal, and outputs the negative DC voltage corresponding to the power level to the signal line between the first input/output terminal and the third transmission line.

For that reason, there can be obtained the semiconductor switch which is easily downsized, and is capable of changing over the signal according to the input power at the time of reception while keeping the performance of the receiver system with a simple configuration.

Further, according to the above-mentioned semiconductor switch, there is no transistor connected in series between the first input/output terminal and the second input/output terminal, and hence a loss of the switch at the time of reception can be made smaller than that in the above-mentioned first to third embodiments.

First Modified Example of Fourth Embodiment

In the above-mentioned fourth embodiment, one second FET 5 is disposed. However, the number of second FETs 5 is not limited to one, and a plurality of second FETs 5 may be disposed.

Figure 15:
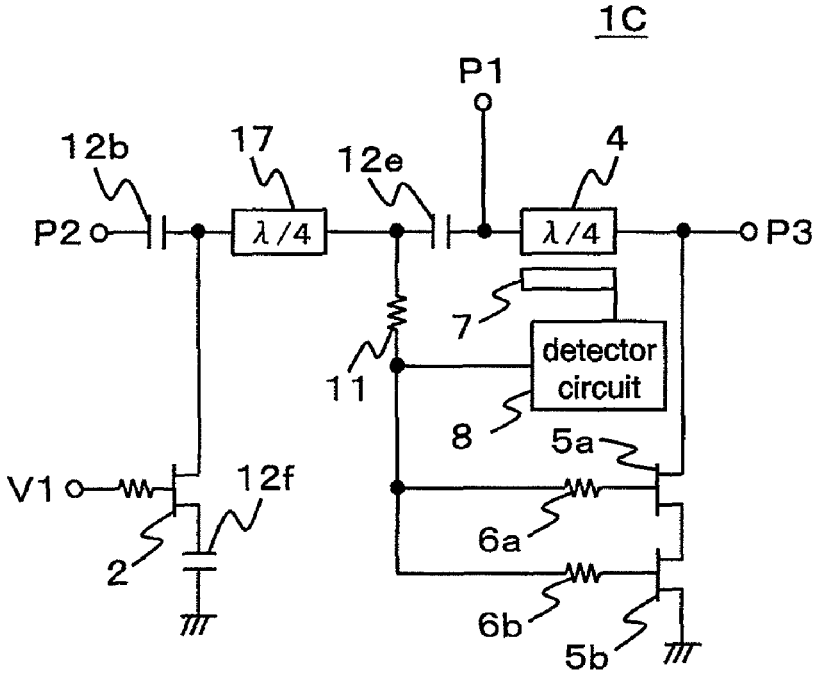
FIG. 15 is a circuit diagram illustrating a semiconductor switch according to a first modified example of the fourth embodiment of the present invention.

FIG. 15 is a circuit diagram illustrating a configuration in which a plurality of second FETs 5 are disposed in the semiconductor switch 1C illustrated in FIG. 14.

Referring to FIG. 15, two second FETs 5*a* and 5*b* are connected in series between the transmission line 4 and the third input/output terminal P3. Other configurations are identical with those of FIG. 14, and therefore their description is omitted.

In this case, a power (current, voltage) applied to the plurality of second FETs 5 can be dispersed with respect to the high input power, and hence the RF signal with the higher power can be dealt with.

Second Modified Example of Fourth Embodiment

A circuit capable of improving isolation at the time of blocking the RF signal can be configured by using a plurality of first FETs 2.

Figure 16:
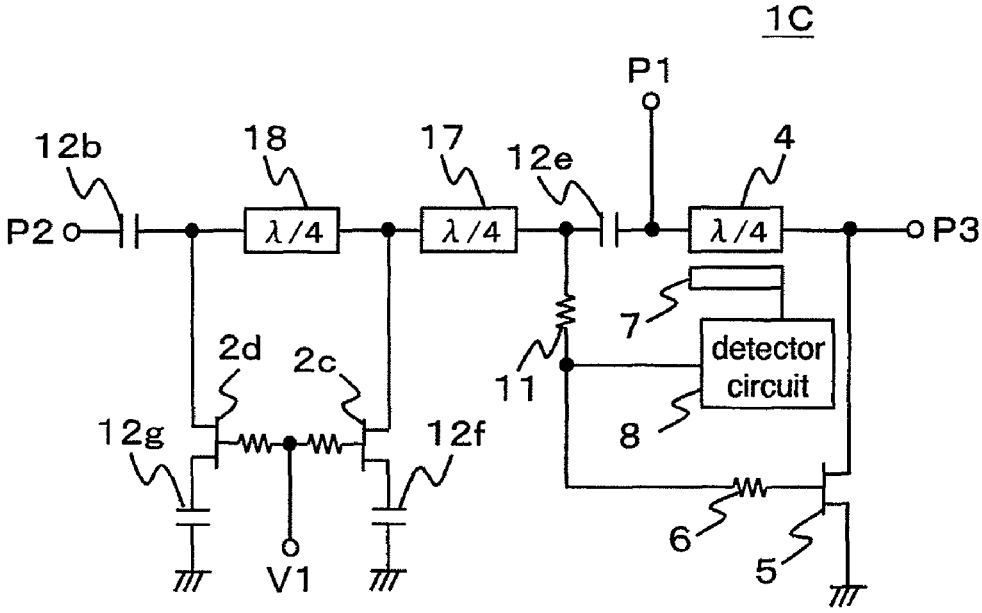
FIG. 16 is a circuit diagram illustrating a semiconductor switch according to a second modified example of the fourth embodiment of the present invention.

FIG. 16 is another circuit diagram illustrating a configuration in which a plurality of first FETs 2 are disposed in the semiconductor switch 1C illustrated in FIG. 14.

Referring to FIG. 16, a transmission line 18 having a length of ¼ wavelength with respect to a desired RF signal is connected between the transmission line 17 and the second input/output terminal P2. Further, one of the drain electrodes and the source electrodes of two first FETs 2*c* and 2*d* are connected in parallel to each other on both sides of the transmission line 18. Another of the drain electrodes and the source electrodes of the two first FETs 2*c* and 2*d* are grounded through the DC cut capacitors 12*f* and 12*g*, respectively. Further, both of the gate electrodes of the two first FETs 2*c* and 2*d* are connected to the control voltage application terminal V1 through the gate bias resistors. Other configurations are identical with those of FIG. 14, and therefore their description is omitted.

Hereinafter, the operation of the semiconductor switch IC configured as described above is described.

When a voltage satisfying V1<Vp1 is applied to the control voltage application terminal V1, and the power level of the RF signal branched by the transmission line 7 is low, the two first FETs 2*c* and 2*d* are of off-capacitance, whereby the RF signal input to the first input/output terminal P1 is output from the second input/output terminal P2. In this situation, the second FET 5 is of on-resistance, and the impedance at the third input/output terminal P3 side viewed from the first input/output terminal P1 is high. As a result, the RF signal from the first input/output terminal P1 to the third input/output terminal P3 is blocked.

In this example, when the power level of the RF signal branched by the transmission line 7 is high, the two first FETs 2*c* and 2*d* are of on-resistance by the negative DC voltage Vmnt output from the detector circuit 8, and the impedance at the second input/output terminal P2 side viewed from the first input/output terminal P1 becomes high. In this situation, the impedance at the second input/output terminal P2 side viewed from the first input/output terminal P1 is higher than that in the case of using one first FET 2. Further, the second FET 5 is of off-capacitance by the negative voltage Vmnt applied to the gate electrode, and as a result, the RF signal input to the first input/output terminal P1 is output from the third input/output terminal P3, and passes through the dummy resistor (refer to FIG. 21). Accordingly, isolation at the time of blocking the RF signal to the second input/output terminal P2 can be improved.

In this modified example, pluralities of first FETs 2 and transmission lines 17 and 18 are connected, thereby enabling the isolation between the first input/output terminal P1 and the second input/output terminal P2 to be highly taken even if the frequency is high. Further, no RF signal passes between the drain and the source of the first FET 2, and hence the loss at the time of reception can be reduced.

Fifth Embodiment

Figure 17:
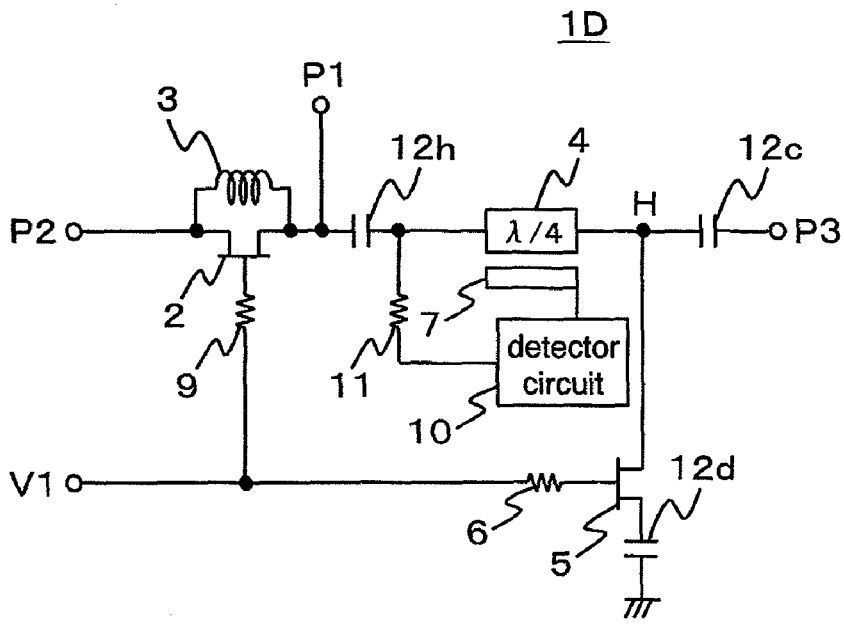
FIG. 17 is a circuit diagram illustrating a semiconductor switch according to a fifth embodiment of the present invention.

FIG. 17 is a circuit diagram illustrating a semiconductor switch 1D according to a fifth embodiment of the present invention. The semiconductor switch 1D is used as a changeover switch, for example, in an RF module illustrated in FIG. 20.

Referring to FIG. 17, the first FET 2 is connected between the first input/output terminal P1 and the second input/output terminal P2. Further, the inductor 3 is connected in parallel between the drain electrode and the source electrode of the first FET 2.

The transmission line 4 having a length of ¼ wavelength with respect to a desired RF signal is connected between the first input/output terminal P1 and the third input/output terminal P3. Further, one of the drain electrode and source electrode of the second FET 5 is connected between the transmission line 4 and the third input/output terminal P3, and another of the drain electrode and source electrode is grounded through the DC cut capacitor 12*d*. The gate electrodes of the first FET 2 and the second FET 5 are connected to the control voltage application terminal V1 through the gate bias resistor 9 and the gate bias resistor 6, respectively.

Further, DC cut capacitors 12*h* and 12*c* are connected to the transmission line 4 side at a branch point at which a signal line is branched from the first input/output terminal P1 to the second input/output terminal P2 or the third input/output terminal P3, and to the third input/output terminal P3, respectively.

Further, the transmission line 7 arranged in parallel to the transmission line 4 and allowing a part of the RF signal passing through the transmission line 4 to be branched by coupling is disposed in the transmission line 4. The detector circuit 10 that detects the power level of the branched RF signal and outputs the positive DC voltage Vmnt corresponding to the power level is connected to the end of the transmission line 7 at the second FET 5 side. Further, the output of the detector circuit 10 is connected to a signal line between the DC cut capacitor 12*h* and the transmission line 4 through the bias resistor 11.

Figure 20:
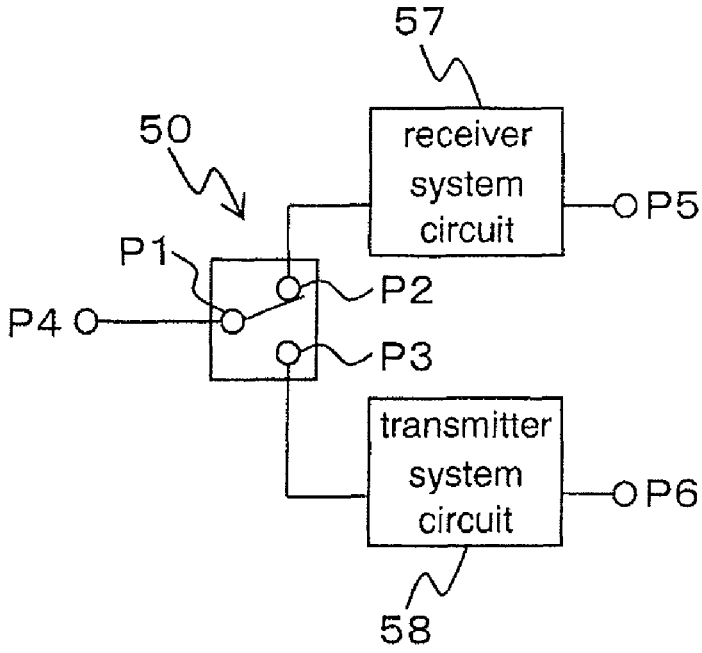
FIG.20 PRIOR ART
FIG. 20 is a circuit diagram illustrating an RF module when the semiconductor switch of FIG. 19 is used as a changeover switch.

The second input/output terminal P2 is connected with a receiver circuit illustrated in FIG. 20, and the third input/output terminal P3 is connected with a transmitter circuit illustrated in FIG. 20, likewise.

Hereinafter, an operation of the semiconductor switch 1D configured as described above is described.

At the time of transmission, a voltage V1L satisfying V1L<Vp2 is applied to the control voltage application terminal V1, whereby the first FET 2 and the second FET 5 are of off-capacitance, respectively, and the transmission RF signal input to the third input/output terminal P3 is output from the first input/output terminal P1.

In this example, when a transmission signal of a large power is transmitted, a voltage of the RF signal having a large maximum amplitude Vrf is applied to a connection point (connection point H) of the transmission line 4 and the second FET 5 (Vrf>0). Accordingly, in order to hold the second FET 5 in the off state, it is necessary that the voltage at the control voltage application terminal V1 is controlled to a voltage (for example, about −50 V) lower than a voltage (−Vrf+Vp2) determined by adding the pinch-off voltage Vp2 of the second FET 5 to the negative maximum peak voltage (−Vrf) of the RF signal.

In the semiconductor switch 1D according to the fifth embodiment, the positive DC voltage Vmnt corresponding to the power level of the transmission signal is output from the detector circuit 10, and hence it is possible to relatively decrease the gate voltage by increasing the voltage at the connection point H, and to hold the second FET 5 in the off state. The voltage at the connection point H fluctuates in a range of from Vmnt−Vrf to Vmnt+Vrf, and the voltage at the connection point H is prevented from being largely inclined toward the low voltage side due to bias caused by the positive DC voltage Vmnt. In this situation, a relative gate voltage Vg2 of the second FET 5 with respect to the connection point H fluctuates in a range of from V1L−(Vmnt+Vrf) to V1L−(Vmnt−Vrf), and the voltage V1L satisfying V1L−Vmnt+Vrf<Vp2 is applied to the control voltage application terminal V1 at the time of transmission, thereby enabling the gate voltage Vg2 to be held to be lower than the pinch-off voltage Vp2. For that reason, in order that the second FET 5 is not affected by the RF signal at the time of transmission, when no bias of Vmnt is applied, the voltage V1L of the control voltage application terminal V1 must satisfy V1L<Vp2−Vrf. However, in the fifth embodiment, control can be made to hold a low impedance between the first input/output terminal P1 and the third input/output terminal P3 by a voltage (for example, about −5 V) having a smaller absolute value.

In the case of the RF signal of a constant amplitude, when the DC voltage Vmnt is smaller than the maximum amplitude Vrf of the RF signal, the voltage V1L can be made a voltage closer to the pinch-off voltage Vp2 as Vmnt is closer to Vrf. Further, in the case of using a voltage doubler rectifier circuit satisfying Vmnt>Vrf, etc., the voltage V1L can satisfy V1L<Vp2.

On the other hand, at the time of reception, a voltage V1H satisfying V1H>Vp2 is applied to the control voltage application terminal V1, whereby the first FET 2 and the second FET 5 are of on-resistance, respectively, and the RF signal input to the first input/output terminal P1 is output from the second input/output terminal P2.

In this example, when it is assumed that the maximum amplitude of the RF signal at the branch point H is Vrf, the voltage at the branch point H fluctuates in a range of from Vmnt-Vrf to Vmnt+Vrf, and the gate voltage Vg2 fluctuates in a range of from V1H−(Vmnt+Vrf) to V1H−(Vmnt−Vrf). Accordingly, when the amplitude of the RF signal input to the first input/output terminal P1 is small, and the condition of V1H−(Vmnt+Vrf)>Vp2 is satisfied, the second FET 5 becomes on, and an impedance between the first input/output terminal P1 and the third input/output terminal P3 becomes high. Accordingly, the RF signal input to the first input/output terminal P1 flows into the receiver circuit (refer to FIG. 20) connected to the second input/output terminal P2.

When the amplitude of the RF signal is large, and V1H−(Vmnt+Vrf)<Vp2 is satisfied, the second FET 5 turns off at the moment when the RF signal satisfies the above-mentioned condition, and a part of the RF signal flows into the third input/output terminal P3 from the first input/output terminal P1. When the amplitude of the RF signal is further increased, and V1H−(Vmnt−Vrf)<Vp2 is satisfied, the second FET 5 is held in the off state, and the impedance between the first input/output terminal P1 and the third input/output terminal P3 becomes low. When an impedance matching resistor or the like is inserted into the output part of the transmitter circuit (refer to FIG. 20) connected to the third input/output terminal P3, the RF signal can be let escape through the resistor. As a result, the receiver circuit can be protected. In order to hold the second FET 5 in the off state with respect to the RF signal of the large amplitude, it is desirable to develop a voltage close to Vrf as the DC voltage Vmnt being the output of the detector circuit 10. In order to hold the second FET 5 in the off state with respect to the RF signal of an arbitrary large amplitude, a double rectifier circuit or the like is used in the detector circuit 10 to provide a DC voltage Vmnt satisfying Vmnt≧Vrf.

In the semiconductor switch according to the fifth embodiment of the present invention, the first transistor is connected in series between the first input/output terminal and the second input/output terminal. Further, the inductor is connected in parallel between the source electrode and the drain electrode of the first transistor. The detector circuit outputs the positive DC voltage corresponding to the power level of the high frequency signal branched from the transmission line which is inserted between the first input/output terminal and the third input/output terminal to the signal line between the DC cut capacitor connected to the first input/output terminal and the first transmission line. For that reason, according to the above-mentioned semiconductor switch, the voltage applied to the control voltage application terminal at the time of transmission can be controlled as a voltage smaller in absolute value than the negative maximum peak amplitude of the RF signal, and hence the configuration of the semiconductor switch can be more simplified. Further, there can be obtained the semiconductor switch which is easily downsized, and is capable of changing over the signal according to the input power at the time of reception while keeping the performance of the receiver system with a simple configuration.

Sixth Embodiment

Figure 18:
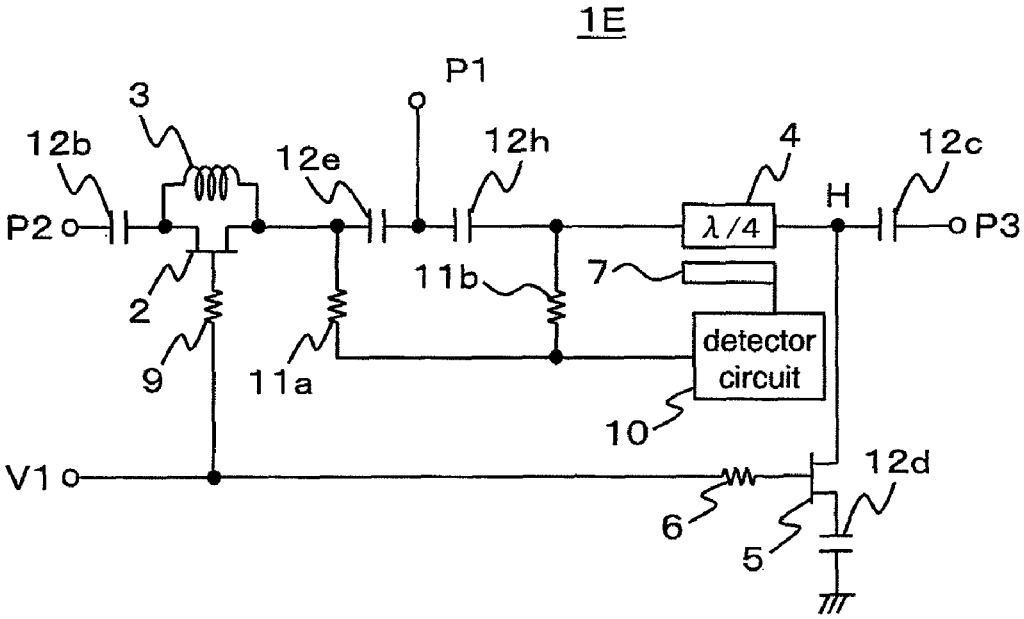
FIG. 18 is a circuit diagram illustrating a semiconductor switch according to a sixth embodiment of the present invention.
Figure 19:
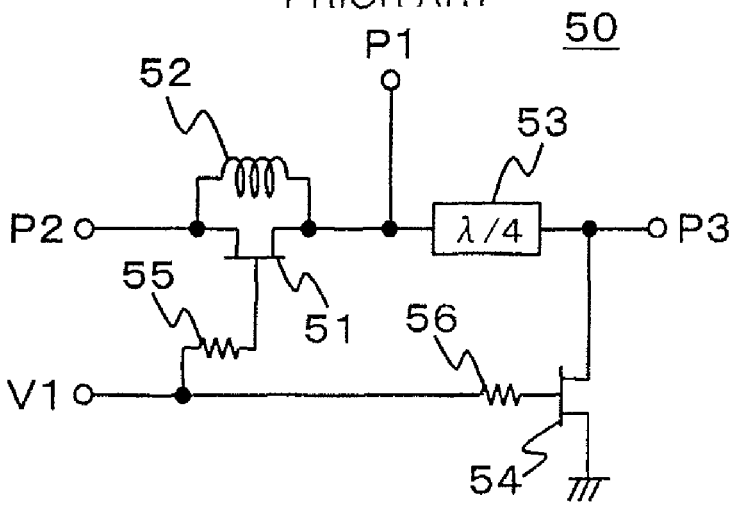
FIG.19 PRIOR ART
FIG. 19 is a circuit diagram illustrating a conventional semiconductor switch.

FIG. 18 is a circuit diagram illustrating a semiconductor switch 1E according to a sixth embodiment of the present invention. The semiconductor switch 1E is used as a changeover switch, for example, in the RF module illustrated in FIG. 20.

Referring to FIG. 18, the first FET 2 is connected between the first input/output terminal P1 and the second input/output terminal P2. Further, the inductor 3 is connected in parallel between the drain electrode and the source electrode of the first FET 2. Further, the DC cut capacitors 12*e* and 12*b* are connected between the first input/output terminal P1 and the first FET 2 and between the first FET 2 and the second input/output terminal P2, respectively. The DC cut capacitors 12*h* and 12*c* are connected to the transmission line 4 side of the branch point at which the signal line is branched from the first input/output terminal P1 to the second input/output terminal P2 or the third input/output terminal P3, and to the third input/output terminal P3, respectively.

The transmission line 4 having a length of ¼ wavelength with respect to a desired RF signal is connected between the first input/output terminal P1 and the third input/output terminal P3. Further, one of the drain electrode and source electrode of the second FET 5 is connected between the transmission line 4 and the third input/output terminal P3, and another of the drain electrode and source electrode is grounded through the DC cut capacitor 12*d*. The gate electrode of the first FET 2 and the gate electrode of the second FET 5 are connected to the control voltage application terminal V1 through the gate bias resistor 9 and the gate bias resistor 6, respectively.

Further, the transmission line 7 arranged in parallel to the transmission line 4 and allowing a part of the RF signal passing through the transmission line 4 to be branched by coupling is disposed in the transmission line 4. The detector circuit 10 that detects the power level of the branched RF signal and outputs the positive DC voltage Vmnt corresponding to the power level is connected to the end of the transmission line 7 at the second FET 5 side. The output of the detector circuit 10 is connected to a signal line between the DC cut capacitor 12*e* and the first FET 2 through a bias resistor 11*a*. The output of the detector circuit 10 is also connected to a signal line between the DC cut capacitor 12*h* and the transmission line 4 through a bias resistor 11*b*.

The second input/output terminal P2 is connected with the receiver system circuit illustrated in FIG. 20, and the third input/output terminal P3 is connected with the transmitter system circuit illustrated in FIG. 20, likewise.

Hereinafter, an operation of the semiconductor switch 1E configured as described above is described.

At the time of reception, a voltage V1H satisfying V1H>Vp1, Vp2 is applied to the control voltage application terminal V1, whereby the first FET 2 and the second FET 5 are of on-resistance, respectively, and the RF signal input to the first input/output terminal P1 is output from the second input/output terminal P2.

When a large RF signal is input to the first input/output terminal P1 to generate the large RF signal in the transmission line 7 in a state where the voltage V1H satisfying V1H>Vp1, Vp2 is applied to the control voltage application terminal V1, the detector circuit 10 generates the positive detected output voltage, and the gate voltage of the first FET 2 is relatively decreased. Accordingly, the first FET 2 is of off-capacitance, and the impedance between the first input/output terminal P1 and the second input/output terminal P2 is high. At the same time, the gate voltage of the second FET 5 is relatively decreased by the positive detected output voltage applied to the signal line between the DC cut capacitor 12*h* and the transmission line 4 from the detector circuit 10, and hence the second FET 5 is of off-capacitance, and the impedance between the first input/output terminal P1 and the third input/output terminal P3 is low.

In order to hold the low impedance between the first input/output terminal P1 and the third input/output terminal P3 when the large RF signal is input, as in the description of the fifth embodiment, V1H−(Vmnt−Vrf)<Vp2 must be satisfied. Further, in order to hold the first FET 2 in the off state, and hold the high impedance between the first input/output terminal P1 and the second input/output terminal P2 when the large RF signal is input, the gate voltage Vg1 with respect to the source electrode or the drain electrode of the first FET 2 must be kept to be lower than the pinch-off voltage Vp1, and V1H−(Vmnt−Vrf)<Vp1 must be satisfied. Accordingly, when the RF signal of the large amplitude is input to the first input/output terminal P1, in order to sufficiently protect the receiver circuit, V1H satisfying those two conditions may be set. Further, it is desirable to develop a voltage close to Vrf as the DC voltage Vmnt being the output of the detector circuit 10. Further, in order to hold the second FET 5 in the off state with respect to the RF signal of an arbitrary large amplitude, a double rectifier circuit or the like is used in the detector circuit 10 to provide a DC voltage Vmnt satisfying Vmnt≧Vrf.

On the other hand, at the time of transmission, a voltage V1L satisfying V1L<Vp1, Vp2 is applied to the control voltage application terminal V1, whereby the first FET 2 and the second FET 5 are of off-capacitance, respectively, and the transmission RF signal input to the third input/output terminal P3 is output from the first input/output terminal P1.

When the transmission signal of a large power is transmitted, the voltage of the RF signal having the large maximum amplitude Vrf is applied to the connection point (connection point H) between the transmission line 4 and the second FET 5. Therefore, in order to hold the second FET 5 in the off state, it is necessary that the voltage at the control voltage application terminal V1 is controlled to a voltage lower than a voltage (−Vrf+Vp2) determined by adding the pinch-off voltage Vp2 of the second FET 5 to the negative maximum peak voltage (−Vrf) of the RF signal.

In the semiconductor switch 1E according to the sixth embodiment, the positive DC voltage Vmnt corresponding to the power level of the transmission signal is output from the detector circuit 10, and hence it is possible to relatively decrease the gate voltage by increasing the voltage at the connection point H, and to hold the second FET 5 in the off state. For the same reason as that in the description of the fifth embodiment, in the gate voltage Vg2 of the second FET 5 and the pinch-off voltage Vp2 of the second FET 5, the voltage V1L satisfying V1L−Vmnt+Vrf<Vp2 is applied to the control voltage application terminal V1, thereby enabling the semiconductor switch to be controlled.

When the transmission signal of the large power is transmitted, in order to hold the first FET 2 in the off state, and hold the high impedance between the first input/output terminal P1 and the second input/output terminal P2, the gate voltage Vg1 with respect to the source electrode or the drain electrode in the first FET 2 must be held to be lower than the pinch-off voltage Vp1, and V1L−(Vmnt−Vrf)<Vp1 must be satisfied. Accordingly, when the transmission signal of the large power is transmitted by the semiconductor switch according to the sixth embodiment, in order to hold the low impedance between the first input/output terminal P1 and the third input/output terminal P3 with stability, and sufficiently protect the receiver circuit, the V1L satisfying the above-mentioned two conditions may be set. Further, it is desirable to develop a voltage close to Vrf as the DC voltage Vmnt being the output of the detector circuit 10. Further, in order to hold the second FET 5 in the off state with respect to the RF signal of an arbitrary large amplitude, a double rectifier circuit or the like is used in the detector circuit 10 to provide a DC voltage Vmnt satisfying Vmnt≧Vrf.

In the semiconductor switch according to the sixth embodiment of the present invention, the first transistor is connected in series between the first input/output terminal and the second input/output terminal. Further, the inductor is connected in parallel between the source electrode and the drain electrode of the first transistor. The detector circuit outputs the positive DC voltage corresponding to the power level of the high frequency signal branched from the transmission line which is inserted between the first input/output terminal and the third input/output terminal to the signal line between the DC cut capacitor connected to the first input/output terminal and the first transistor, and the signal line between another DC cut capacitor connected to the first input/output terminal and the first transmission line.

For that reason, according to the above-mentioned semiconductor switch, the voltage applied to the control voltage application terminal at the time of transmission can be controlled as a voltage smaller in absolute value than the negative maximum peak amplitude of the RF signal, and the configuration of the semiconductor switch can be more simplified. Further, when the input power at the time of reception is large, the first input/output terminal and the second input/output terminal are isolated from each other, and the input power can be supplied to the third input/output terminal from the first input/output terminal. Therefore, the receiver system can be more effectively protected.

Further, there can be obtained the semiconductor switch which is easily downsized, and is capable of changing over the signal according to the input power at the time of reception while keeping the performance of the receiver system with a simple configuration.

What is claimed is:

1. A semiconductor switch including a first input/output terminal, a second input/output terminal, a third input/output terminal, wherein, the first input/output terminal and the second input/output terminal are connected by a first route, and the first input/output terminal and the third input/output terminal are connected by a second route;

a first transistor having a source electrode, a gate electrode, and a drain electrode, connected between the first input/output terminal and the second input/output terminal;

a first transmission line having a length and connected between the first input/output terminal and the third input/output terminal;

a second transmission line arranged parallel to the first transmission line, for branching a part of a high frequency signal passing through the first transmission line by coupling; and a detector circuit connected to an end of the second transmission line, for outputting a DC voltage corresponding to power level of the high frequency signal branched by the second transmission line, wherein the first transistor is controlled and switched according to an output from the detector circuit to switch between the first route and the second route.

2. The semiconductor switch according to claim 1, including an inductor connected between the source electrode and the drain electrode of the first transistor, wherein the first transistor is connected in series between the first input/output terminal and the second input/output terminal, and the detector circuit outputs a DC voltage corresponding to the power level of the high frequency signal branched by the second transmission line to the gate electrode of the first transistor, and turns off the first transistor when the power level is high.

3. The semiconductor switch according to claim 1, including a second transistor having a source electrode, a gate electrode, and a drain electrode and connected between the first transmission line and the third input/output terminal, and an inductor connected between the source electrode and the drain electrode of the first transistor, wherein the first transistor is connected in series between the first input/output terminal and the second input/output terminal, and the detector circuit outputs a DC voltage corresponding to the power level of the high frequency signal branched by the second transmission line to the gate electrode of the first transistor and a gate electrode of the second transistor, and turns off the first transistor and the second transistor when the power level is high.

4. The semiconductor switch according to claim 1, including an inductor connected between the source electrode and the drain electrode of the first transistor, wherein the first transistor is connected in series between the first input/output terminal and the second input/output terminal, and the detector circuit outputs a DC voltage corresponding to the power level of the high frequency signal branched by the second transmission line to a signal line between the first input/output terminal and the first transistor, and turns off the first transistor and the second transistor when the power level is high.

5. The semiconductor switch according to claim 1, including a third transmission line having a length and connected in series between the first input/output terminal and the second input/output terminal, wherein the first transistor is connected between the first input/output terminal and the third transmission line, and the detector circuit outputs a DC voltage corresponding to the power level of the high frequency signal branched by the second transmission line to a signal line between the first input/output terminal and the third transmission line, and turns on the first transistor and turns off the second transistor when the power level is high.

6. The semiconductor switch according to claim 1, including an inductor connected between the source electrode and the drain electrode of the first transistor, wherein the first transistor is connected between the first input/output terminal and the second input/output terminal, and the detector circuit outputs a DC voltage corresponding to the power level of the high frequency signal branched by the second transmission line to a signal line between the first input/output terminal and the first transmission line, and turns off the second transistor when the power level is high.

7. The semiconductor switch according to claim 1, including an inductor connected between the source electrode and the drain electrode of the first transistor, wherein the first transistor is connected between the first input/output terminal and the second input/output terminal, and the detector circuit outputs a DC voltage corresponding to the power level of the high frequency signal branched by the second transmission line to a signal line between the first input/output terminal and the first transistor and a signal line between the first input/output terminal and the first transmission line, and turns off the first transistor and the second transistor even when the power level is high.

8. The semiconductor switch according to claim 5, wherein the first transmission line and the third transmission line have lengths of ¼ wavelength with respect to a specified high frequency signal.

9. The semiconductor switch according to claim 1, wherein the detector circuit is connected to an end of the second transmission line at an opposite side of the third input/output terminal.

10. The semiconductor switch according to claim 1, including a plurality of the first transistors.

11. The semiconductor switch according to claim 3, including a plurality of the second transistors.

12. The semiconductor switch according to claim 1, wherein the detector circuit comprises a double rectifier circuit.

13. A semiconductor switch MMIC, including the semiconductor switch according to claim 1, and a semi-insulating substrate on which the semiconductor switch is located.

14. A changeover switch RF module comprising the semiconductor switch according to claim 1.

15. A power resistance switch RF module comprising the semiconductor switch according to claim 1.

16. A transmitter and receiver module comprising the semiconductor switch according to claim 1.

* * * * *